United States Patent [19]

Scheve et al.

[11] Patent Number: 4,982,663

[45] Date of Patent: Jan. 8, 1991

[54] SAFE-AND-ARM ARRANGEMENT AND PROJECTILE ARRANGEMENT THEREWITH

[75] Inventors: David M. Scheve, Baltimore; Robert W. Schnepfe, Jr., Upperco, both of Md.

[73] Assignee: AAI Corporation, Hunt Valley, Md.

[21] Appl. No.: 863,766

[22] Filed: May 16, 1986

[51] Int. Cl.[5] ..... F42C 15/24; F42C 15/34

[52] U.S. Cl. ..... 102/251; 102/259

[58] Field of Search ..... 102/251, 259, 258, 254, 102/247, 222, 379, 380

[56] References Cited

U.S. PATENT DOCUMENTS

| | | | |
|---|---|---|---|
| 1,975,809 | 10/1934 | Teitscheid | 102/251 X |
| 1,992,926 | 2/1935 | Towner | 102/251 |
| 2,118,062 | 5/1938 | Woodberry | 102/251 |
| 2,198,697 | 4/1940 | Driggs | 102/254 X |
| 2,336,514 | 12/1943 | Teitscheid et al. | 102/251 |
| 2,755,738 | 7/1956 | Jones et al. | 102/247 |
| 4,449,457 | 5/1984 | Halssig | 102/251 |
| 4,454,816 | 6/1984 | Billard et al. | 102/251 X |

*Primary Examiner*—David H. Brown

[57] ABSTRACT

A safe-and-arm arrangement for a grenade or other projectile, having an interrupter slide member disposed in the path of an ignition/explosive train, in which said interrupter carries a portion of said train and interlocks with a setback pin to prevent arming except after insertion of the grenade or other projectile into a launch barrel and subsequent launching thereof from the barrel.

9 Claims, 2 Drawing Sheets

SAFE-AND-ARM ARRANGEMENT AND PROJECTILE ARRANGEMENT THEREWITH

The U.S. Government has a paid-up license in this invention and the right in limited circumstances to require the patent owner to license others on reasonable terms as provided for by the terms of Contract Number DAAK11-79-C-0123.

This invention relates to safe-and arm arrangements and, more particularly, to a safe-and-arm arrangement which is operable under conditions of low launch acceleration and without any requirement for spin movement.

At the present time, no other device is known that is capable of functioning as a safe-and-arm mechanism under conditions of low-launch acceleration. Current hand and smoke grenades do not have true safe-and-arm mechanisms since the primary explosives are not separated from the booster and lead explosives by an interrupter.

A safe-and-arm device has been defined as a mechanism whose primary purpose is to prevent an unintended functioning of the main charge of the ammunition due to action by the fuze prior to completion of the normal arming operation and which nevertheless enables the explosive train of the ammunition to function after arming.

A safe-and-arm mechanism is provided according to the present invention which affords safety consistent with assembly, handling, storage, transportation, operational readiness and use. Most other safe-and-arm devices require multiple environmental forces, such as a combination of high spin rate and high set-back force to satisfy accepted safe-and-arm safety/performance standards. This naturally entails increased complexity and cost.

In the preferred embodiment of the invention a safe-and-arm device is provided which keeps the grenade safe when subjected to the various handling and loading environments; yet, after insertion of the grenade into a launch barrel bore, effects arming of the grenade under conditions of low launch acceleration and no spin.

According to a further feature, a safe-and-arm mechanism according to the present invention assures a positive means of determining the safe condition before and after assembly of the safe-and-arm mechanism and also prevents installation of an armed grenade into the launch barrel.

It has been shown that a safe-and-arm device according to the present invention keeps the grenade safe under the following environments: bore safe, inadvertent propellant initiation safe, drop safe, vibration safe, jolt safe, jumble safe, detonate out-of-line safe.

Still other objects, features and attendant advantages will become apparent from a reading of the following detailed description of an illustrative and preferred embodiment according to the invention, taken in conjunction with the accompanying drawings, wherein.

Figure 1:
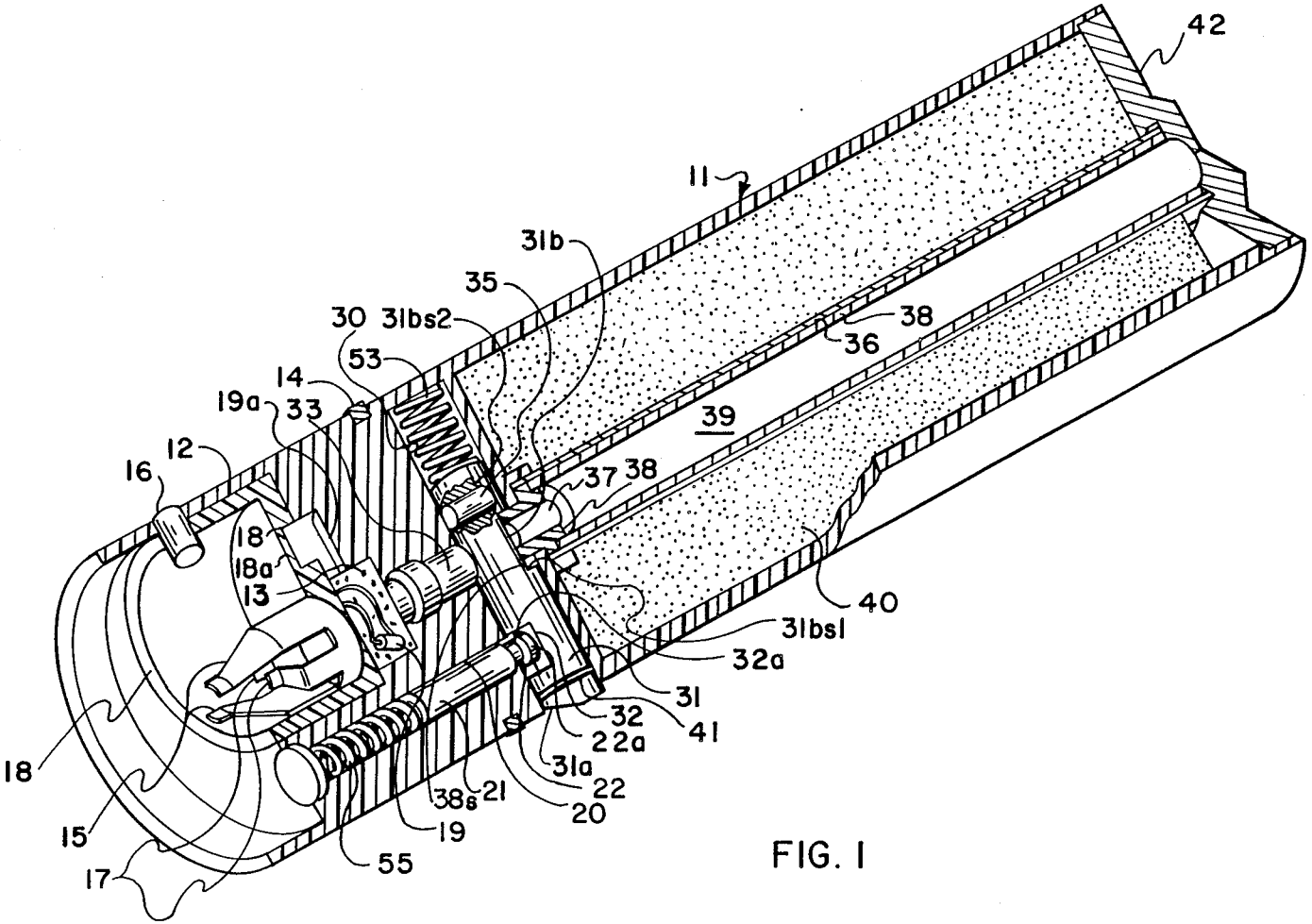
FIG. 1 is an isometric view, in partial section, of a grenade embodying the invention.

A grenade or cartridge 11 is provided which may be launched from a conventional smooth bore barrel, not shown, through ignition of a propellant charge 13, as by electric ignition through electrical contacts 15, 17, suitably mounted on a retention cup 18 suitably secured to body 12 as by pin 16. Contacts 15, 17 connect with an electrically initiated squib or electric match 19 disposed in the propellant chamber. The main body 12 of the grenade 11 may have a conventional bore seal 14 for propellant gas sealing action during launch, and has various suitable holes and cavities integrally molded therein for accommodating and housing a safe-and-arm mechanism, to be subsequently described. The surfaces of the walls of the holes 20 and 30 have a smooth fine finish to insure smooth unrestrained motion of a setback pin 21 and slider 31, respectively.

Plural annularly spaced lateral propellant gas passageways **19*a* are formed in the body 12 leading from the chamber containing the propellant 13, and communicating with corresponding thin-walled blow-out rupture zones 18*a* formed in the cup 18**, to enable propellant gas discharge and propulsion during launch.

Slider 31 serves as the interrupter or barrier separating a first portion of the ignition/explosive path having a pyrotechnic delay train 33 therein (which communicates with the forward end of the propellant charge 13 and is ignited by burning of the launch propellant charge 13), from both a sensitive detonator or primary explosive 35 which is carried in an opening extending through the slider 31, and from a booster lead explosive detonator 37, the activation and detonation of which effects the explosion of the main high energy explosive charge 39, which may itself serve any desired purpose such as dissemination of a charge of material 40 into the atmosphere. Explosive 35 and the opening in which it is disposed in slider 31 is spaced from the outer end of slider 31 a distance substantially greater than the distance between one lateral side of the ignition path and the laterally opposite outer surface of body 12, the explosive 35 being thereby offset from the ignition path in the safe position in which the grenade is contained within a launcher tube or barrel (not shown). The cylindrical high-energy explosive charge 39 is housed within a plastic burster tube 38, which in turn fits within a cardboard guide tube 36 surrounded by disseminatable material 40. A plastic end cap 42 is suitably ultrasonically welded to the end of the body 12 and holds the explosive charge 39 and material in place.

The slider 31 contains an O-ring seal 41 to prevent harmful environmental agents from entering the grenade 11. The surfaces of the slider 31 that come into contact with the walls of the slider hole 30 have a smooth fine finish to insure smooth sliding action. The slider 31 has an L-shaped slot 32, having a locking foot/lip **32*a*, which serves as an interlock lock to secure a longitudinally slidable setback pin 21 into the non-arm position and to thereby mutually interlock and secure the slider 31** in the safe out-of-line position, interrupting the ignition/explosive train path.

A slider-biasing compression spring 53 is provided which must be strong enough to resiliently hold the slider 31 against the setback pin 21 in normal handling, to thereby maintain the safety interlock action. The slider spring 53 must also be strong enough to move the slider 31, during launch, to the armed position with the detonator 35 in line with the pyrotechnic delay 33 and the booster lead 37, after launch and before the setback pin 21 returns to its non-arm position.

Figure 2:
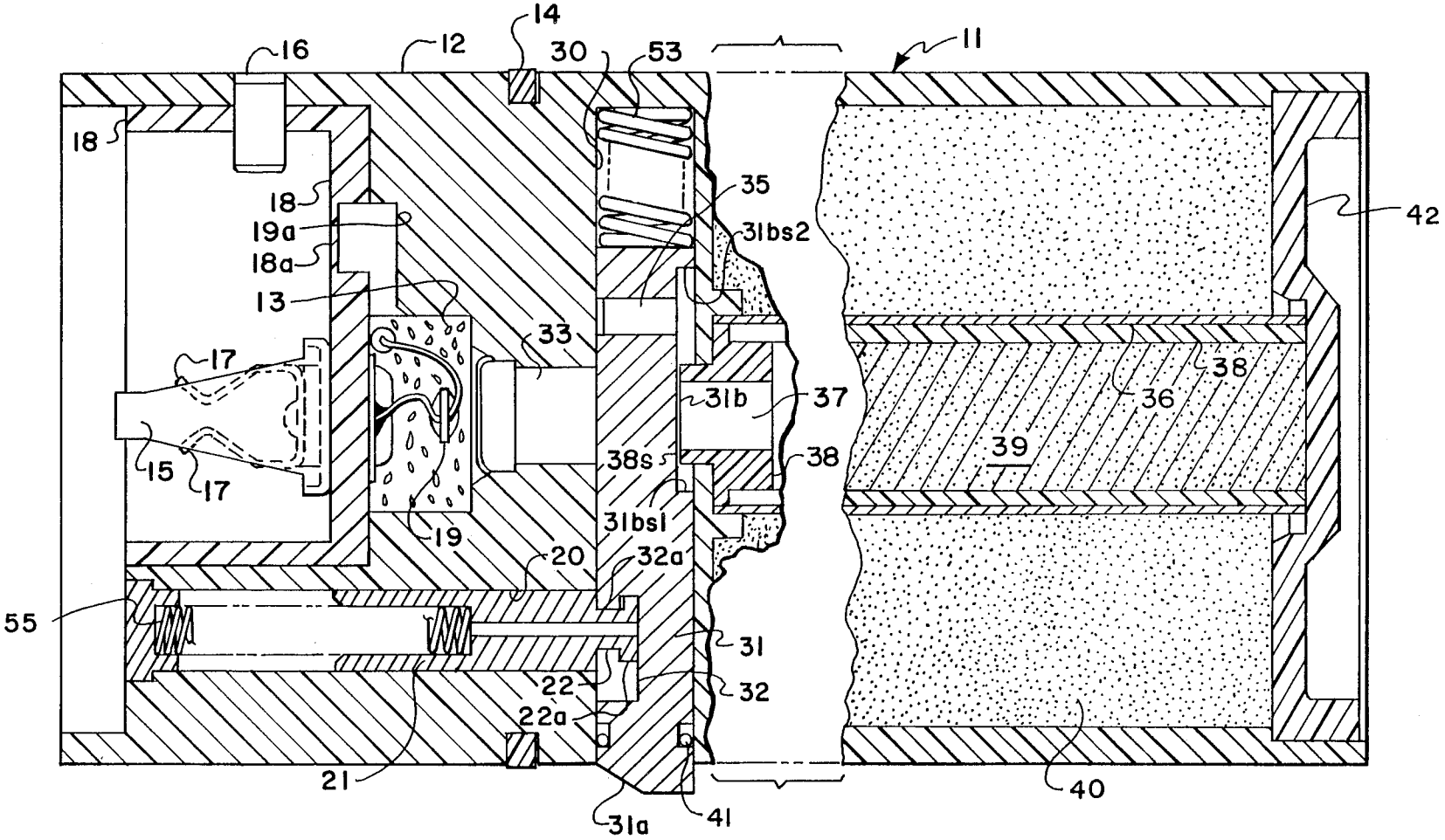
FIG. 2 is a longitudinal section view of the grenade of FIG. 1.

The setback pin 21 is normally resiliently biased into engagement with the slider 31 and L-shaped slot 32 therein, by a compression spring 55, and thereby serves as a positive interlock in cooperation with the slider interlock slot 32 and lip **32*a*, securing the slider 31 in the safe out-of-line and ignition/explosive path-blocking position as shown in FIGS. 1 and 2. Since inertial setback force on the setback pin 21 during launching of the grenade 11 must overcome the force from the setback pin spring 55 to displace the setback pin 21 away from the slider 31, a smooth fine finish is employed on the external surfaces of the setback pin 21 that come into contact with the walls of the longitudinal setback pin hole 20 in the main body 12**.

Adjacent the end of the setback pin 21 an annular groove 22 is formed, to thereby effectively form an annular interlock lip or shoulder **22*a* on the end of the setback pin 21. The lip or shoulder 22*a* and groove 22 are engaged by the L-shaped slot 32 and associated interlock lip or shoulder 32*a* on the slider 31 in the normal interlock condition prior to insertion of the cartridge or grenade 11 into a barrel bore (not shown), thereby locking both the setback pin 21 and the slider 31** in the non-arm position.

The slider 31 also serves as a bore-rider which slides along a barrel bore, and thereby serves to release and enable the setback pin 21 upon insertion into a closely fitting smooth-walled barrel bore (not shown). To this end, the slider 31 has a cam surface 31 formed on its outer end and normally extending slightly beyond the adjacent outer lateral wall surface of the cartridge or grenade body 12, the cam surface **31*a* thereof facing the insertion end of the grenade or cartridge 11**, which in the illustrated embodiment is the rear end.

The entrance to the L-shaped slot 32 is at least as large as the adjacent shouldered or lip end of the setback pin 21 and, upon insertion into a closely fitting smooth-walled barrel bore, the cam surface **31*a* is engaged to thereby slide the slider 31 transversely inwardly into the grenade body 12, which thereby moves the interlock lip 32*a* out of engagement with the interlock lip 22*a* on the end of setback pin 21. This effectively releases the setback pin 21, to thereby enable the setback pin to move rearward. relative to the body 12 and slider 31 as a function of the inertial setback force thereon during the abrupt launch of the grenade 11 upon ignition of the launch propellant charge 13**.

This setback movement of the setback pin 21 releases the slider 31 for a brief initial launch period and, upon exit of the grenade 11 from the launching barrel bore, the slider 31 will be quickly moved by spring 53 to its radially outermost position, in which position the detonator 35 is aligned with the pyrotechnic delay train 33 and the booster lead 37, to thereby enable the completion of the ignition and activation of the main explosive charge 39. The slider 31 has a slot **31*b* formed in its forward face adjacent booster lead 37, with end shoulders 31*bs*1 and 31*bs*2 formed by its opposite ends. Shoulders 31*bs*1 and 31*bs*2 serve as limit stops which engage with a limit stop shoulder boss 38*s* formed on the support mount 38 for booster 37, thereby preventing overtravel of the slider 31 inboard or outboard, and assuring armed alignment of the detonator 35 with the pyrotechnic delay train and booster lead 37 at the outermost position of the slider 31**.

While the invention has been illustrated and described with respect to a single illustrative embodiment, it will be apparent to those skilled in the art that various modifications and improvements maybe made without departing from the scope and spirit of the invention. For instance, while a combined pyrotechnic delay ignition and multiple step-up explosive train is shown in the present embodiment, one may also interrupt and arm a simple ignition train path, or an ignition/delay train path, or other desired energizing path as the occasion requires or as is desired. Also, while the illustrated grenade carries its own launch charge, the grenade or other projectile may be otherwise launched and its ignition or ignition/explosive train path initiated by other than the burning of the propellant, although such is normally the simplest and most desirable mode. Accordingly, the invention is not to be limited by the illustrative embodiment, but only by the scope of the appended claims.

We claim:

1. A projectile arrangement having a safe-and-arm mechanism, comprising a body for insertion into a launching barrel bore, an ignition path for activating a charge of material, a transversely slidable ignition-blocking/enabling member having an opening therein and having a first transverse slide position in which said ignition path is blocked, and a third transverse position in which said opening is positioned in path continuation of said ignition path to thereby enable ignition therepast, means biasing said transversely slidable member toward said third position, a longitudinally slidable setback member normally biased into engagement with said transversely slidable ignition-blocking/enabling member, said longitudinally slidable setback member and said transversely slidable ignition-blocking/enabling member having mutually interlocking elements and being normally mutually interlocked in engagement with one another, each in a respective position in which said transversely slidable member is in said first position whereby said ignition path is blocked, said transversely slidable ignition-blocking/enabling member having an end portion thereof normally extending beyond said body while in said first position and having a cam surface engageable with a barrel bore to thereby slidably move said transverse member into said body to a second release position as a function of insertion of said body into a barrel bore, said second release position of said transversely slidable member effecting release of said longitudinally slidable setback member from said transversely slidable member, while continuing to block said ignition path, said longitudinally slidable setback member being thereupon enabled, in the second release position of said transversely slidable member, to a condition for longitudinal slidable movement away from said transversely slidable member in response to inertial setback forces thereon during abrupt launch of said body from a launch barrel, to thereby release said transversely slidable member from slide-inhibiting action by said setback member, and thereby enabling said transversely slidable member to move to said third position upon subsequent exit from a barrel bore after abrupt launching.

2. A projectile arrangement according to claim 1, said opening in said transversely slidable member being spaced from said end portion of said transversely slidable member a distance greater than the distance between one lateral side of said ignition path and the laterally opposite outer surface of said body so as to thereby offset said opening from said ignition path when said transversely slidable member is in said first transverse slide position.

3. A projectile arrangement according to claim 1, further comprising an activatable charge of material disposed adjacent the end of said ignition path and activatable only after movement of said slidable member to said nonblocking third position relative to said ignition path.

4. A projectile arrangement according to claim 1, further comprising a charge of material ignitable along said ignition path, and ignition means connecting with said ignition path.

5. A projectile arrangement according to claim 4, said slider having an ignitable element disposed in said slidable member opening.

6. A projectile arrangement having a safe-and-arm mechanism according to claim 1, said mutually interlocking elements comprising a locking lip formed on said transversely slidable member, and a locking lip formed on said slidable setback member.

7. A projectile arrangement according to claim 6, and spring means normally resiliently biasing said longitudinally slidable member into engagement with said transversely slidable member.

8. A projectile arrangement according to claim 6, said transversely slidable member locking lip being formed by an L-shaped slot formed in the lateral surface of said transversely slidable member.

9. A projectile arrangement according to claim 8, said locking lip on said longitudinally slidable member being formed by an annular lip at the end of said longitudinally slidable member adjacent said transversely slidable member.

* * * * *